US008123932B2

(12) United States Patent
Montanari et al.

(10) Patent No.: US 8,123,932 B2
(45) **Date of Patent: *Feb. 28, 2012**

(54) PROCESS FOR THE CONVERSION OF HEAVY FEEDSTOCKS SUCH AS HEAVY CRUDE OILS AND DISTILLATION RESIDUES

(75) Inventors: Romolo Montanari, Milan (IT); Mario Marchionna, Milan (IT); Nicoletta Panariti, Lecco (IT); Alberto Delbianco, Milan (IT); Sergio Rosi, Milan (IT)

(73) Assignees: Eni S.p.A., Rome (IT); Snamprogetti S.p.A., San Donato Milanese (IT); Enitechnologie S.p.A., San Donato Milanese (IT)

( * ) Notice: Subject to any disclaimer, the term of this patent is extended or adjusted under 35 U.S.C. 154(b) by 1506 days.

This patent is subject to a terminal disclaimer.

(21) Appl. No.: 10/538,886

(22) PCT Filed: Dec. 12, 2003

(86) PCT No.: PCT/EP03/14545

§ 371 (c)(1), (2), (4) Date: Mar. 24, 2006

(87) PCT Pub. No.: WO2004/056947

PCT Pub. Date: Jul. 8, 2004

(65) Prior Publication Data

US 2006/0175229 A1 Aug. 10, 2006

(30) Foreign Application Priority Data

Dec. 20, 2002 (IT) ..... MI2002A2713
Apr. 8, 2003 (IT) ..... MI2003A0692

(51) Int. Cl.
*C10G 45/00* (2006.01)

(52) U.S. Cl. ..... 208/212; 208/211; 208/213; 208/210; 208/309; 208/108; 208/95

(58) Field of Classification Search ..... 208/212, 208/211, 213, 210, 309, 108, 95
See application file for complete search history.

(56) References Cited

U.S. PATENT DOCUMENTS 2,559,285 A * 7/1951 Douce ..... 208/68

(Continued)

FOREIGN PATENT DOCUMENTS

WO 01/60952 8/2001

OTHER PUBLICATIONS

U.S. Appl. No. 11/404,746, filed Apr. 17, 2006, Marchionna, et al.

(Continued)

*Primary Examiner* — Tam M Nguyen
(74) *Attorney, Agent, or Firm* — Oblon, Spivak, McClelland, Maier & Neustadt, L.L.P.

(57) ABSTRACT

A process for the conversion of heavy feedstocks using hydrotreatment, distillation or flash, and deasphalting that includes mixing a heavy feedstock with a hydrogenation catalyst and subjecting the thus-formed mixture to a hydrotreatment reactor for reaction with one or more of hydrogen and hydrogen sulfide to form a first product stream; subjecting the first product stream to a distillation or flash to form a plurality of distillate fractions; and recycling heavies from the distillation residue and/or tar by deasphalting in the presence of a solvent; where the hydrotreatment reaction product is pre-separated under high pressure to form light and heavy fractions and sending the heavy fraction to the distillation and/or flash.

40 Claims, 1 Drawing Sheet

U.S. PATENT DOCUMENTS

Figure 1:
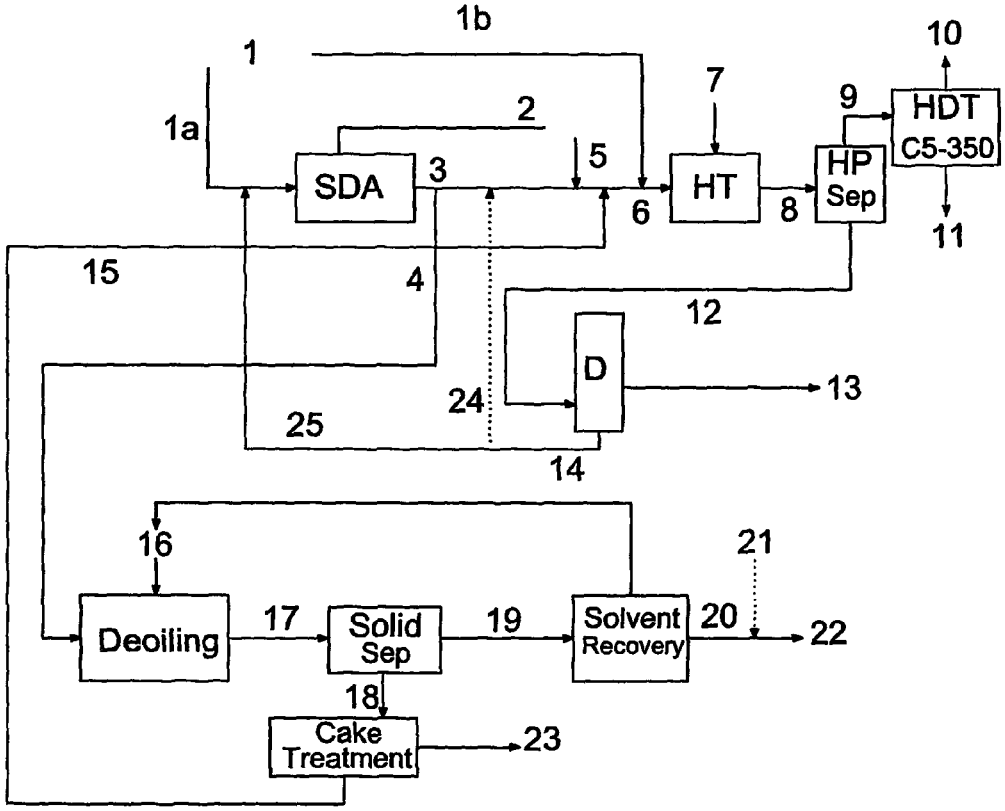

| | | | | |
|---|---|---|---|---|
| 3,723,294 | A | 3/1973 | Gatsis et al. | |
| 4,039,429 | A * | 8/1977 | Van Klinken et al. | 208/50 |
| 4,191,636 | A * | 3/1980 | Fukui et al. | 502/247 |
| 4,400,264 | A | 8/1983 | Kwant et al. | |
| 4,405,441 | A * | 9/1983 | Van Dongen et al. | 208/61 |
| 4,640,762 | A | 2/1987 | Woods et al. | |
| 5,242,578 | A | 9/1993 | Taylor et al. | |
| 5,932,090 | A * | 8/1999 | Marchionna et al. | 208/212 |
| 2003/0089636 | A1 | 5/2003 | Marchionna et al. | |

OTHER PUBLICATIONS

U.S. Appl. No. 11/311,134, filed Dec. 20, 2005, Montanari, et al.
U.S. Appl. No. 11/311,147, filed Dec. 20, 2005, Montanari, et al.
U.S. Appl. No. 12/248,163, filed Oct. 9, 2008, Marchionna, et al.
U.S. Appl. No. 12/375,615, filed Jan. 29, 2009, Marchionna, et al.
U.S. Appl. No. 12/375,610, filed Jan. 29, 2009, Marchionna, et al.
U.S. Appl. No. 12/725,915, filed Mar. 17, 2010, Marchionna, et al.
U.S. Appl. No. 13/169,950, filed Jun. 27, 2011, Marchionna, et al.

* cited by examiner

PROCESS FOR THE CONVERSION OF HEAVY FEEDSTOCKS SUCH AS HEAVY CRUDE OILS AND DISTILLATION RESIDUES

The present invention relates to a process for the conversion of heavy feedstocks, among which heavy crude oils, bitumens from oils sands, distillation residues, various kinds of coal, using three main process units: hydroconversion of the feedstock using catalysts in dispersed phase, distillation and deasphalting, suitably connected and fed with mixed streams consisting of fresh feedstock and conversion products, a post-treatment unit of the light distillates, naphtha and gas oil, being added to said three main units.

The conversion of heavy crude oils, bitumens from oil sands and oil residues into liquid products can be substantially effected by means of two methods: one exclusively thermal, the other through hydrogenating treatment.

Current studies are mainly directed towards hydrogenating treatment, as thermal processes have problems linked to the disposal of the by-products, particularly coke (also obtained in quantities higher than 30% by weight with respect to the feedstock) and to the poor quality of the conversion products.

The hydrogenating processes consist in treating the feedstock in the presence of hydrogen and suitable catalysts.

Hydroconversion technologies currently on the market use fixed bed or ebullated bed reactors and catalysts generally consisting of one or more transition metals (Mo, W, Ni, Co, etc.) supported on silica/alumina (or equivalent material).

Fixed bed technologies have considerable problems in treating particularly heavy feedstocks containing high percentages of heteroatoms, metals and asphaltenes, as these contaminants cause a rapid deactivation of the catalyst.

Ebullated bed technologies have been developed and commercialized for treating these feedstocks; these provide interesting performances but are complex and costly.

Hydrotreatment technologies operating with catalysts in dispersed phase can provide an attractive solution to the drawbacks encountered in the use of fixed bed or ebullated bed technologies. Slurry processes, in fact, combine the advantage of a wide flexibility for the feedstock with high performances in terms of conversion and upgrading, making them, in principle, simpler from a technological point of view.

Slurry technologies are characterized by the presence of catalyst particles having very small average dimensions and being effectively dispersed in the medium: for this reason the hydrogenation processes are simpler and more efficient in all points of the reactor. The formation of coke is greatly reduced and the upgrading of the feedstock is high.

The catalyst can be introduced as a powder with sufficiently reduced dimensions or as an oil-soluble precursor. In the latter case, the active form of the catalyst (generally the metal sulfide) is formed in-situ by thermal decomposition of the compound used, during the reaction itself or after suitable pretreatment.

The metal constituents of the dispersed catalysts are generally one or more transition metals (preferably Mo, W, Ni, Co or Ru). Molybdenum and tungsten have much more satisfactory performances than nickel, cobalt or ruthenium and even more than vanadium and iron (N. Panariti et al., Appl. Catal. A: Gen. 2000, 204, 203).

Even though the use of dispersed catalysts solves most of the problems listed for the technologies described above, it still has disadvantages mainly linked to the life cycle of the catalyst itself and quality of the products obtained.

The conditions of use of these catalysts (type of precursors, concentration, etc.) are, in fact, extremely important both from an economic point of view and also with respect to environmental impact.

The catalyst can be used at a low concentration (a few hundreds of ppm) in a "once-through" configuration, but in this case the upgrading of the reaction products is generally insufficient (A. Delbianco et al., Chemtech, November 1995, 35). When operating with extremely active catalysts (for example molybdenum) and with higher concentrations of catalysts (thousands of ppm of metal), the quality of the product obtained is much better but a recycling of the catalyst is compulsory.

The catalyst leaving the reactor can be recovered by separation from the product obtained by hydrotreatment (preferably from the bottom of the distillation column downstream of the reactor) by means of the conventional methods such as decanting, centrifugation or filtration (U.S. Pat. No. 3,240,718; U.S. Pat. No. 4,762,812). Part of said catalyst can be recycled to the hydrogenation process without further treatment. The catalyst recovered using the known hydrotreatment processes, however, normally has a reduced activity with respect to the fresh catalyst making an appropriate regeneration step necessary in order to restore the catalytic activity and recycle at least part of said catalyst to the hydrotreatment reactor. Furthermore, these recovery processes of the catalyst are costly and also extremely complex from a technological point of view.

All the hydroconversion processes described above allow more or less high conversion levels to be reached depending on the feedstock and type of technology used, but in any case generating a non-converted residue at the stability limit, herein called tar, which, from case to case, can vary from 15 to 85% of the initial feedstock. This product is used to produce fuel oil, bitumens or it can be used as a feedstock in gasification processes.

In order to increase the overall conversion level of the cracking processes of residues, schemes have been proposed which comprise the recycling of more or less significant quantities of tar in the cracking unit. In the case of hydroconversion processes with catalysts dispersed in slurry phase, the recycling of the tar also allows the recovery of the catalyst, insomuch that the same applicants in IT-95A001095 describe a process which allows the recovered catalyst to be recycled to the hydrotreatment reactor without the necessity of a further regeneration step, at the same time obtaining a good-quality quality product without the production of residue (zero residue refinery).

This process comprises the following steps:

- mixing the heavy crude oil or distillation residue with a suitable hydrogenation catalyst and sending the mixture obtained to a hydrotreatment reactor into which hydrogen or a mixture of hydrogen and $H_2S$ is charged;
- sending the stream containing the hydrotreatment reaction product and the catalyst in dispersed phase to a distillation zone in which the most volatile fractions (naphtha and gas oil) are separated;
- sending the high-boiling fraction obtained in the distillation step to a deasphalting step, thus producing two streams, one consisting of deasphalted oil (DAO), the other consisting of asphaltenes, catalyst in dispersed phase and possibly coke and enriched with metals coming from the initial feedstock;
- recycling at least 60%, preferably at least 80%, of the stream consisting of asphaltenes, catalyst in dispersed phase and possibly coke, rich in metals, to the hydrotreatment zone.

It was then found, as described in patent application IT-MI2001A-001438, that, in the upgrading of heavy crude oils or bitumens from oil sands to complex hydrocarbon mixtures to be used as raw material for further conversion processes to distillates, different process configurations can be used, with respect to those described above.

The process, described in patent application It-MI2001A-001438, for the conversion of heavy feedstocks with the combined use of the following three process units: hydroconversion with catalysts in slurry phase (HT), distillation or flash (D), deasphalting (SDA), is characterized in that the three units operate on mixed streams consisting of fresh feedstock and recycled streams, using the following steps:

- sending at least a fraction of the heavy feedstock to a deasphalting section (SDA) in the presence of solvents obtaining two streams, one consisting of deasphalted oil (DAO), the other of asphaltenes;
- mixing the asphaltenes with the remaining fraction of heavy feedstock not sent to the deasphalting section and with a suitable hydrogenation catalyst and sending the mixture obtained to a hydrotreatment reactor (HT) into which hydrogen or a mixture of hydrogen and $H_2S$ is charged;
- sending the stream containing the hydrotreatment reaction product and the catalyst in dispersed phase to one or more distillation or flash steps (D) whereby the most volatile fractions, among which the gases produced in the hydrotreatment reaction, naphtha and gas oil, are separated;
- recycling at least 60% by weight, preferably at least 80%, more preferably at least 95%, of the distillation residue (tar) or the liquid leaving the flash unit, containing catalyst in dispersed phase, rich in metal sulfides produced by demetallation of the feedstock and possibly coke and various kinds of carbonaceous residues, to the deasphalting zone.

It is generally necessary to effect a flushing on the asphaltene stream leaving the deasphalting section (SDA) to ensure that these elements do not accumulate too much in the hydrotreatment reactor and, in the case of deactivation of the catalyst, to remove part of the catalyst which is replaced with fresh catalyst. This however is generally not the case as the catalyst maintains its activity for a long period; as it is necessary however to effect a flushing for the above reasons, some of the catalyst must obviously be used up even if it is nowhere near being completely deactivated. Furthermore, although the volumes of the flushing stream (0.5-4% with respect to the feedstock), are extremely limited compared with other hydrotreatment technologies, they still create considerable problems relating to their use or disposal.

The application described is particularly suitable when the heavy fractions of complex hydrocarbon mixtures when the heavy fractions of complex hydrocarbon mixtures produced by the process (bottom of the distillation column) must be used as feedstock for catalytic cracking plants, both Hydrocracking (HC) and fluid bed Catalytic Cracking (FCC).

The combined action of a catalytic hydrogenation unit (HT) with an extraction process (SDA) allows deasphalted oils to be produced with a reduced content of pollutants (metals, sulfur, nitrogen, carbonaceous residue), and which can therefore be more easily treated in catalytic cracking processes.

A further aspect to be taken into consideration, however, is that the naphtha and gas oil produced directly by the hydrotreatment unit still contain numerous contaminants (sulfur, nitrogen, . . . ) and must in any case be reprocessed to obtain the end-products.

It has now been found that both the process described in patent application IT-MI2001A-001438 and also the process described in patent application IT-95A001095, now fully incorporated in the present patent application, can be further improved by the insertion of an additional secondary post-treatment hydrogenation section of the $C_2$-500° C. fraction, preferably the $C_5$-350° C. fraction.

The secondary post-treatment hydrogenation section consists in the further hydrotreatment of the $C_2$-500° C. fraction, preferably the $C_5$-350° C. fraction, deriving from the high pressure separator section upstream of the distillation.

The process, object of the present invention, for the conversion of heavy feedstocks selected from heavy crude oils, distillation residues, heavy oils coming from catalytic treatment, thermal tars, bitumens from oil sands, various kinds of coals and other high-boiling feedstocks of a hydrocarbon origin known as black oils, by the combined use of the following three process units: hydroconversion with catalysts in slurry phase (HT), distillation (D), deasphalting (SDA), comprises the following steps:

- mixing at least part of the heavy feedstock and/or at least most of the stream containing asphaltenes obtained in the deasphalting unit with a suitable hydrogenation catalyst and sending the mixture obtained to a hydrotreatment reactor (HT) into which hydrogen or a mixture of hydrogen and $H_2S$ is charged;
- sending the stream containing the hydrotreatment reaction product and the catalyst in dispersed phase to one or more distillation or flash steps (D) whereby the different fractions coming from the hydrotreatment reaction are separated;
- recycling at least part of the distillation residue (tar) or liquid leaving the flash unit, containing the catalyst in dispersed phase, rich in metal sulfides produced by demetallation of the feedstock and possibly coke, to the deasphalting zone (SDA) in the presence of solvents, optionally also fed with at least a fraction of the heavy feedstock, obtaining two streams, one consisting of deasphalted oil (DAO) and the other containing asphaltenes, characterized in that the stream containing the hydrotreatment reaction product and the catalyst in dispersed phase, before being sent to one or more distillation or flash steps, is subjected to a high pressure separation pre-step in order to obtain a light fraction and a heavy fraction, the heavy fraction alone being sent to said distillation step(s) (D).

The light fraction obtained by means of the high pressure separation step can be sent to a hydrotreatment section, producing a lighter fraction containing $C_1$-$C_4$ gas and $H_2S$ and a heavier fraction containing hydrotreated naphtha and gas oil.

The insertion of the secondary post-treatment hydrogenation section of the $C_2$-500° C. fraction, preferably the $C_5$-350° C. fraction, exploits the availability of this fraction together with hydrogen at a relatively high pressure, which is approximately that of the hydrotreatment reactor, allowing the following advantages to be obtained:

- it allows the production, starting from oil feedstocks extremely rich in sulfur, of fuels in line with the most severe specifications on the sulfur content (<10-50 ppm of sulfur) and improved with respect to other characteristics of diesel gas oil such as density, polyaromatic hydrocarbon content and cetane number;
- the distillates produced do not suffer from problems of stability.

The hydrogenation post-treatment on a fixed bed consists in the preliminary separation of the reaction effluent of the hydrotreatment reactor (HT) by means of one or more separators operating at a high pressure and a high temperature. Whereas the heavy part, extracted from the bottom, is sent to the main distillation unit, the part extracted at the head, a $C_2$-500° C. fraction, preferably a $C_5$-350° C. fraction, is sent to a secondary treatment section in the presence of hydrogen, available at a high pressure, wherein the reactor is a fixed bed reactor and contains a typical desulfuration/dearomatization catalyst, in order to obtain a product which has a much lower sulfur content and also lower levels of nitrogen, a lower total density and, at the same time, as far as the gas oil fraction is concerned, increased cetane numbers.

The hydrotreatment section normally consists of one or more reactors in series; the product of this system can then be further fractionated by distillation to obtain a totally desulfurated naphtha and a diesel gas oil within specification as fuel.

The hydrodesulfuration step with a fixed bed generally uses typical fixed bed catalysts for the hydrodesulfuration of gas oils; this catalyst, or possibly also a mixture of catalysts or a set of reactors with different catalysts having different properties, considerably refines the light fraction, by significantly reducing the sulfur and nitrogen content, increasing the hydrogenation degree of the feedstock, thus decreasing the density and increasing the cetane number of the gas oil fraction, at the same time reducing the formation of coke.

The catalyst generally consists of an amorphous part based on alumina, silica, silico-alumina and mixtures of various mineral oxides on which a hydrodesulfurating component is deposited (with various methods) together with a hydrogenating agent. Catalysts based on molybdenum or tungsten, with the addition of nickel and/or cobalt deposited on an amorphous mineral carrier are typical catalysts for this type of operation.

The hydrogenating post-treatment reaction is carried out at an absolute pressure slightly lower than that of the primary hydrotreatment step, generally ranging from 7 to 14 MPa, preferably from 9 to 12 MPa; the hydrodesulfuration temperature ranges from 250 to 500° C., preferably from 280 to 420° C.; the temperature normally depends on the desulfuration level required. The space velocity is another important variable in controlling the quality of the product obtained: it can range from 0.1 to 5 $h^{-1}$, preferably from 0.2 to 2 $h^{-1}$.

The quantity of hydrogen mixed with the feedstock is fed to a stream between 100 and 5000 $Nm^3/m^3$, preferably between 300 and 1000 $Nm^3/m^3$.

In addition to the secondary post-treatment hydrogenation section, there can also optionally be a further secondary post-treatment section of the flushing stream.

Said secondary section consists in the posttreatment of the flushing stream in order to significantly reduce its entity and allow at least part of the catalyst, still active, to be recycled to the hydrotreatment reactor.

In this case, the fraction of stream containing asphaltenes, coming from the deasphalting section (SDA), called flushing stream, is sent to a treatment section with a suitable solvent for the separation of the product into a solid fraction and a liquid fraction from which said solvent can be subsequently removed.

The optional treatment section of the flushing effluent, preferably in a quantity ranging from 0.5 to 10% by volume with respect to the fresh feedstock, consists in a deoiling step with a solvent (toluene or gas oil or other streams rich in aromatic components) and a separation of the solid fraction from the liquid fraction.

At least part of said liquid fraction can be fed:

- to the "pool fuel oil", as such or after being separated from the solvent and/or after the addition of a suitable fluxing liquid;
- and/or to the hydrotreatment reactor (HT) as such.

In specific cases, the solvent and fluxing liquid can coincide.

The solid fraction can be disposed of as such or, more advantageously, it can be sent to a selective recovery treatment of the transition metal or metals contained in the transition catalyst (for example molybdenum) (with respect to the other metals present in the starting residue, nickel and vanadium) and optional recycling of the stream rich in transition metal (molybdenum) to the hydrotreatment reactor (HT).

This composite treatment has the following advantages with respect to a traditional process:

- the entity of the flushing fraction is greatly reduced;
- a large part of the flushing fraction is upgraded to fuel oil by separating the metals and coke;
- the fraction of fresh catalyst to be added to the feedstock to the primary hydrotreatment is reduced, as at least a part of the molybdenum extracted from the selective recovery treatment is recycled.

The deoiling step consists in the treatment of the flushing stream, which represents a minimum fraction of the asphaltene stream coming from the deasphalting section (SDA) at the primary hydrotreatment plant of the heavy feedstock, with a solvent which is capable of bringing the highest possible quantity of organic compounds to liquid phase, leaving the metallic sulfides, coke and more refractory carbonaceous residues (insoluble toluene or similar products), in solid phase.

Considering that the components of a metallic nature can become pyrophoric when they are very dry, it is advisable to operate in an inert atmosphere, containing as little oxygen and humidity as possible.

Various solvents can be advantageously used in this deoiling step; among these, aromatic solvents such as toluene and/or xylene blends, hydrocarbon feedstocks available in the plant, such as the gas oil produced therein, or in refineries, such as Light Cycle Oil coming from the FCC unit or Thermal Gas oil coming from the Visbreaker/Thermal Cracker unit, can be mentioned.

Within certain limits, the operating rate is facilitated by increases in the temperature and the reaction time but an excessive increase is unadvisable for economic reasons.

The operating temperatures depend on the solvent used and on the pressure conditions adopted; temperatures ranging from 80 to 150° C., however, are recommended; the reaction times can vary from 0.1 to 12 h, preferably from 0.5 to 4 h.

The volumetric ratio solvent/flushing stream is also an important variable to be taken into consideration; it can vary from 1 to 10 (v/v), preferably from 1 to 5, more preferably from 1.5 to 3.5.

Once the mixing phase between the solvent and flushing stream has been completed, the effluent maintained under stirring is sent to a separation section of the liquid phase from the solid phase.

This operation can be one of those typically used in industrial practice such as decanting, centrifugation or filtration.

The liquid phase can then be sent to a stripping and recovery phase of the solvent, which is recycled to the first treatment step (deoiling) of the flushing stream. The heavy fraction which remains, can be advantageously used in refineries as a stream practically free of metals and with a relatively low sulfur content. If the treatment operation is effected with a gas oil, for example, part of said gas oil can be left in the heavy product to bring it within the specification of pool fuel oil.

Alternatively, the liquid phase can be recycled to the hydrogenation reactor.

The solid part can be disposed of as such or it can be subjected to additional treatment to selectively recover the catalyst (molybdenum) to be recycled to the hydrotreatment reactor.

It has been found, in fact, that by adding a heavy feedstock but without metals such as, for example, part of the Deasphalted Oil (DAO) coming from the deasphalting unit of the plant itself, to the above solid phase, and mixing said system with acidulated water (typically with an inorganic acid), almost all of the molybdenum is maintained in the organic phase whereas substantial quantities of other metals migrate towards the aqueous phase. The two phases can be easily separated and the organic phase can then be advantageously recycled to the hydrotreatment reactor.

The solid phase is dispersed in a sufficient quantity of organic phase (for example deasphalted oil coming from the same process) to which acidulated water is added.

The ratio between aqueous phase and organic phase can vary from 0.3 to 3; the pH of the aqueous phase can vary from 0.5 to 4, preferably from 1 to 3.

Various kinds of heavy feedstocks can be treated: they can be selected from heavy crude oils, bitumens from oil sands, various types of coals, distillation residues, heavy oils coming from catalytic treatment, for example heavy cycle oils from catalytic cracking treatment, bottom products from hydroconversion treatment, thermal tars (coming for example from visbreaking or similar thermal processes), and any other high-boiling feedstock of a hydrocarbon origin generally known in the art as black oils.

As far as the general process conditions are concerned, reference should be made to what is already specified in patent applications IT-MI2001A-001438 and IT-95A001095.

According to what is described in patent application IT-95A001095, all the heavy feedstock can be mixed with a suitable hydrogenation catalyst and sent to the hydrotreatment reactor (HT), whereas at least 60%, preferably at least 80% of the stream containing asphaltenes, which also contains catalyst in dispersed phase and possibly coke and is enriched with metal coming from the initial feedstock, can be recycled to the hydrotreatment zone.

According to what is described in patent application IT-MI2001A-001438, part of the heavy feedstock and at least most of the stream containing asphaltenes, which also contains catalyst in dispersed phase and possibly coke, are mixed with a suitable hydrogenation catalyst and sent to the hydrotreatment reactor, whereas the remaining part of the quantity of the heavy feedstock is sent to the deasphalting section.

According to what is described in patent application IT-MI2001A-001438, at least most of the stream containing asphaltenes, which essentially consists of said asphaltenes, is mixed with a suitable hydrogenation catalyst and sent to the hydrotreatment reactor, whereas all the heavy feedstock is fed to the deasphalting section.

When only part of the distillation residue (tar) or liquid leaving the flash unit is recycled to the deasphalting zone (SDA), at least part of the remaining quantity of said distillation or flash residue can be sent to the hydrotreatment reactor, optionally together with at least part of the stream containing asphaltenes coming from the deasphalting section (SDA).

The catalysts used can be selected from those obtained from precursors decomposable in-situ (metallic naphthenates, metallic derivatives of phosphonic acids, metal-carbonyls, etc.) or from preformed compounds based on one or more transition metals such as Ni, Co, Ru, W and Mo: the latter is preferred due to its high catalytic activity.

The concentration of the catalyst, defined on the basis of the concentration of the metal or metals present in the hydroconversion reactor, ranges from 300 to 20,000 ppm, preferably from 1,000 to 10,000 ppm.

The hydrotreatment step is preferably carried out at a temperature ranging from 370 to 480° C., more preferably from 380 to 440° C., and at a pressure ranging from 3 to 30 MPa, more preferably from 10 to 20 MPa.

The hydrogen is fed to the reactor, which can operate with both the down-flow and, preferably, up-flow procedure. Said gas can be fed to different sections of the reactor.

The distillation step is preferably effected at reduced pressure ranging from 0.0001 to 0.5 MPa, preferably from 0.001 to 0.3 MPa.

The hydrotreatment step can consist of one or more reactors operating within the range of conditions specified above. Part of the distillates produced in the first reactor can be recycled to the subsequent reactors.

The deasphalting step, effected by means of an extraction with a solvent, hydrocarbon or non-hydrocarbon (for example with paraffins or iso-paraffins having from 3 to 6 carbon atoms), is generally carried out at temperatures ranging from 40 to 200° C. and at a pressure ranging from 0.1 to 7 MPa. It can also consist of one or more sections operating with the same solvent or with different solvents; the recovery of the solvent can be effected under subcritical or supercritical conditions with one or more steps, thus allowing a further fractionation between deasphalted oil (DAO) and resins.

The stream consisting of deasphalted oil (DAO) can be used as such, as synthetic crude oil (syncrude), optionally mixed with the distillates, or it can be used as feedstock for fluid bed Catalytic Cracking or Hydrocracking treatment.

Depending on the characteristics of the crude oil (metal content, sulfur and nitrogen content, carbonaceous residue), the feeding to the whole process can be advantageously varied by sending the heavy residue alternately either to the deasphalting unit or to the hydrotreatment unit, or contemporaneously to the two units, modulating:

- the ratio between the heavy residue to be sent to the hydrotreatment section (fresh feedstock) and that to be sent for deasphalting; said ratio preferably varies from 0.01 to 100, more preferably from 0.1 to 10, even more preferably from 1 to 5;
- the recycling ratio between fresh feedstock and tar to be sent to the deasphalting section; said ratio preferably varies from 0.01 to 100, more preferably from 0.1 to 10;
- the recycling ratio between fresh feedstock and asphaltenes to be sent to the hydrotreatment section; said ratio can vary in relation to the variations in the previous ratios;
- the recycling ratio between tar and asphaltenes to be sent to the hydrotreatment section; said ratio can vary in relation to the variations in the previous ratios;

This flexibility is particularly useful for fully exploiting the complementary characteristics of the deasphalting units (discrete nitrogen reduction, and dearomatization) and hydrogenation units (high removal of metals and sulfur).

Depending on the type of crude oil, the stability of the streams in question and quality of the product to be obtained (also in relation to the particular treatment downstream), the fractions of fresh feedstock to be fed to the deasphalting section and hydrotreatment section can be modulated in the best possible way.

The application described is particularly suitable when the heavy fractions of the complex hydrocarbon mixtures produced by the process (bottom of the distillation column) are to be used as feedstock for catalytic cracking plants, both Hydrocracking (HC) and fluid bed Catalytic Cracking (FCC).

The combined action of a catalytic hydrogenation unit (HT) with an extractive process (SDA) allows deasphalted oils to be produced with a reduced content of contaminants (metals, sulfur, nitrogen, carbonaceous residue), and which can therefore be more easily treated in the catalytic cracking processes.

A preferred embodiment of the present invention is provided hereunder with the help of the enclosed FIG. 1 which, however, should in no way be considered as limiting the scope of the invention itself.

The heavy feedstock (1), or at least a part thereof (1*a*), is sent to the deasphalting unit (SDA), an operation which is effected by means of extraction with a solvent.

Two streams are obtained from the deasphalting unit (SDA): one stream (2) consisting of deasphalted oil (DAO), the other containing asphaltenes (3).

The stream containing asphaltenes, with the exception of a flushing (4), is mixed with the fresh make-up catalyst (5) necessary for reintegrating that lost with the flushing stream (4), with part of the heavy feedstock (1*b*) not fed to the deasphalting section and part of the tar (24) not fed to the deasphalting section (SDA) and optionally with the stream (15) coming from the optional treatment section of the flushing (whose description will be dealt with further on in the text) to form the stream (6) which is fed to the hydrotreatment reactor (HT) into which hydrogen is charged (or a mixture of hydrogen and $H_2S$) (7). A stream (8), containing the hydrogenation product and the catalyst in dispersed phase, leaves the reactor and is first fractionated in one or more separators operating at high pressure (HP Sep). The fraction at the head (9) is sent to a fixed bed hydrotreatment reactor (HDT $C_5$-350) where a light fraction containing $C_1$-$C_4$ gas and $H_2S$ (10) and a $C_5$-350° C. fraction (11) containing hydrotreated naphtha and gas oil, are produced. A heavy fraction (12) leaves the bottom of the high pressure separator and is fractionated in a distillation column (D) from which the vacuum gas oil (13) is separated from the distillation residue containing the dispersed catalyst and coke. This stream, called tar (14), is completely or mostly (25) recycled to the deasphalting reactor (SDA), with the exception of the fraction (24) mentioned above.

The flushing stream (4) can be sent to a hydrotreatment section (Deoiling) with a solvent (16) forming a mixture containing liquid and solid fractions (17). Said mixture is sent to a treatment section of solids (Solid Sep) from which a solid effluent (18) is separated and also a liquid effluent (19), which is sent to a recovery section of the solvent (Solvent Recovery). The recovered solvent (16) is sent back to the deoiling section whereas the heavy effluent (20) is sent to the Fuel Oil fraction (22), as such or with the addition of a possible fluxing liquid (21).

The solid fraction (18) can be disposed of as such or it can be optionally sent to a section for additional treatment (Cake Treatment), such as that described, for example, in the text and examples, to obtain a fraction which is practically free of molybdenum (23), which is sent for disposal and a fraction rich in molybdenum (15), which can be recycled to the hydrotreatment reactor.

Some examples are provided hereunder for a better illustration of the invention, which however should in no way be considered as limiting its scope.

EXAMPLE 1

Following the scheme represented in FIG. 1, the following experiment was effected.

Deasphalting Step

Feedstock: 300 g of vacuum residue from Ural crude oil (Table 1)

Deasphalting agent; 2000 cc of liquid propane (extraction repeated three times)

Temperature: 80° C.

Pressure: 35 bar

TABLE 1

| Characteristics Ural of vacuum residue 500° C.+ | |
|---|---|
| API gravity | 10.8 |
| Sulfur (w %) | 2.6 |
| Nitrogen (w %) | 0.7 |
| CCR (w %) | 18.9 |
| Ni + V (ppm) | 80 + 262 |

Hydrotreatment Step

Reactor: 3000 cc, steel, suitably shaped and equipped with magnetic stirring

Catalyst; 3000 ppm of Mo/feedstock added using molybdenum naphthenate as precursor Temperature: 410° C.

Pressure: 16 MPa of hydrogen

Residence time: 4 h

Flash Step

Effected with a laboratory apparatus for liquid evaporation (T=120° C.)

Experimental Results

Ten consecutive deasphalting tests were effected using for each test a feedstock consisting of Ural vacuum residue (fresh feedstock) and atmospheric residue obtained from the hydrotreatment reaction of $C_3$ asphaltenes of the previous step in order to allow the complete recycling of the catalyst added during the first test. For each step, the autoclave was fed with a quantity of feedstock consisting of Ural vacuum residue (fresh feedstock) and $C_3$ asphaltenes deriving from the deasphalting unit so as to bring the total mass of feedstock (fresh feedstock+recycled $C_3$ asphaltenes) to the initial value of 300 g.

The ratio between the quantity of fresh feedstock and quantity of recycled product reached under these operating conditions was 1:1.

The data relating to the outgoing streams after the last recycling (weight % with respect to the feedstock) are provided hereunder.

Gas: 7%

Naphtha ($C_5$-170° C.): 8%

Atmospheric gas oil (AGO 170-350° C.): 17%

Deasphalted oil (VGO+DAO): 68%

The asphaltene stream recovered at the end of the test contains all the catalyst fed initially, the sulfides of the metals Ni and V produced during the ten hydrotreatment reactions and a quantity of coke in the order of about 1% by weight with respect to the total quantity of Ural residue fed. In the example indicated, it is not necessary to effect a flushing of the recycled stream. Table 2 specifies the characterization of the product obtained.

TABLE 2 characteristics of test reaction products according to Example 1

| | Sulfur (w %) | Nitrogen (w %) | Sp. Gr. (g/ml) | RCC (w %) | Ni + V (ppm) |
|---|---|---|---|---|---|
| Naphtha $C_5$-170° C. | 0.06 | 450 | 0.768 | — | — |
| AGO 170–350° C. | 0.52 | 2100 | 0.870 | — | — |
| VGO + DAO | 1.45 | 2500 | 0.938 | 3 | 1 |

EXAMPLE 2

Following the scheme represented in FIG. 1, the products leaving the head of a high pressure separator are sent to a fixed bed reactor, fed with a stream of reagents with a downward movement. The reactor is charged with a typical commercial hydrodesulfuration catalyst based on molybdenum and nickel.

The operating conditions are the following:

LHSV: 0.5 $h^{-1}$

Hydrogen pressure: 10 Mpa

Reactor temperature: 390° C.

Table 3 indicates the quality of the feeding entering the fixed bed reactor and of the product obtained.

TABLE 3

Hydrotreatment of the $C_5$-350° C. fraction coming from the treatment of Ural residue 500° C.+

| | Feedstock | Product |
|---|---|---|
| Sp. Gravity (g/ml) | 0.8669 | 0.8294 |
| MonoAromatics (w %) | 30.1 | 19.5 |
| DiAromatics (w %) | 8.3 | 1.2 |
| TriAromatics (w % ) | 2.8 | 0.4 |
| PolyAromatics (w %) | 11.1 | 1.6 |
| Sulfur (ppm) | 5300 | 37 |
| Nitrogen (ppm) | 2280 | 3 |
| Distillation curve | | |
| $T_{10}$ (° C.) | 187 | 145 |
| $T_{50}$ (° C.) | 271 | 244 |
| $T_{90}$ (° C.) | 365 | 335 |

EXAMPLE 3

20.7 g of flushing stream (composition indicated in Table 4), coming from the conversion plant of a Ural residue 500+, are treated with 104 g of toluene (w/w ratio solvent/flushing=5) at 100° C. for 3 h. The resulting fraction is subjected to filtration. 3.10 g of solid are collected (composition indicated in Table 5) together with 17.60 g of heavy oil (after removal of the toluene by evaporation), which has a metal content as specified in Table 6.

TABLE 4

Characteristics of the flushing stream coming from Ural treatment 500° C.+

| | |
|---|---|
| Sp.Gravity (g/ml) | 1.1 |
| S (w %) | 2.4 |
| Mo (w %) | 0.68 |
| Ni (w % ) | 0.12 |
| V (w %) | 0.36 |
| Fe (w %) | 0.07 |

TABLE 5

Characteristics of the solid (cake) coming from the treatment with toluene of the Ural 500° C.+ flushing stream

| | |
|---|---|
| C (w %) | 82.0 |
| H (w %) | 3.9 |
| S (w %) | 4.8 |
| Mo (w %) | 4.1 |
| Ni (w %) | 0.6 |
| V (w %) | 2.2 |
| Fe (w %) | 0.4 |

TABLE 6

Metal content in the heavy oil extracted from the treatment of the flushing stream coming from Ural 500° C.+ treatment

| | |
|---|---|
| Mo (ppm) | 10 |
| Ni (ppm) | 26 |
| V (ppm) | 23 |
| Fe (ppm) | 10 |

EXAMPLE 4

The same procedure is used as described in Example 3; 10.6 g of flushing stream (composition indicated in Table 4) are treated with 62 ml of gas oil, produced during a hydrotreatment test of Ural residue, as described in example 1 above and with the quality specified in Table 2; the gas oil/flushing ratio is 5 and the operation is carried out at 130° C. for 6 h. The resulting fraction is subjected to centrifugation (5000 rpm). 1.78 g of solid are collected (composition indicated in Table 7) together with 8.82 g of heavy oil (after removal of the gas oil by evaporation).

TABLE 7

Characteristics of the solid (cake) coming from treatment with gas oil of the Ural 500° C.+ flushing stream

| | |
|---|---|
| Mo (w %) | 3.43 |
| Ni (w %) | 0.53 |
| V (w %) | 1.75 |

EXAMPLE 5

1.0 g of solid residue deriving from the treatment described in Example 3 and with the composition specified in Table 5, is treated with a mixture of 50 ml of acidulated water (pH=2) and 50 ml of Deasphalted Oil, DAO, with the composition indicated in Table 8.

After 24 h at 70° C., the liquid phases are left to decant and the analysis of the metals is effected in the two phases.

The total amount (>99%) of molybdenum remains in the organic phase, whereas the nickel and vanadium are found in the aqueous phase in quantities corresponding to an extraction efficiency of 23.5% and 24.4%, respectively.

The organic phase containing molybdenum was then fed with fresh Ural residue to a hydrotreatment test, carried out with the procedure described in Example 1: the molybdenum maintains its catalytic activity properties.

TABLE 8

| Characteristics of the DAO coming from the treatment of Ural 500° C.+ residue | | | | | |
|---|---|---|---|---|---|
| | Sulfur (w %) | Nitrogen (ppm) | Sp. Gr. (g/ml) | RCC (w %) | Ni + V (ppm) |
| DAO | 1.02 | 2100 | 0.934 | 3 | <1 |

EXAMPLE 6

The same procedure is adopted as described in Example 5 but using, instead of DAO, a gas oil produced during a hydrotreatment test of Ural residue (see Example 1) and acidulated water (pH=2)

The total amount of molybdenum remains in the organic phase, whereas the nickel and vanadium are found in the aqueous phase in quantities corresponding to an extraction efficiency of 41.0% and 26.8%, respectively.

The invention claimed is:

1. A process for the conversion of a heavy feedstock selected from the group consisting of heavy crude oils, distillation residues, heavy oils coming from catalytic treatment, thermal tars, bitumens from oil sands, coals and high-boiling feedstocks of a hydrocarbon origin known as black oils, including the combined three process units: hydroconversion with catalysts in slurry phase, distillation or flash, and deasphalting, said method comprising:

mixing at least part of the heavy feedstock and/or at least most of a stream containing asphaltenes obtained from a deasphalting unit with a suitable hydrogenation catalyst to form a first mixture and sending the first mixture to a hydrotreatment reactor into which hydrogen or a mixture of hydrogen and $H_2S$ is charged to form a hydrotreatment reaction product;

sending a stream containing the hydrotreatment reaction product and the catalyst in dispersed phase to one or more distillation or flash units whereby one or more different fractions coming from the hydrotreatment reaction product are separated and a distillation residue or liquid comprising the catalyst in dispersed phase and which is rich in metal sulfides produced by demetallation of the feedstock is formed;

recycling at least part of the distillation residue or liquid, to a deasphalting zone in the presence of solvents, optionally also fed with at least a fraction of the heavy feedstock, to form a second stream and a third stream, wherein the second stream comprises deasphalted oil and the third stream comprises other asphaltenes, wherein the stream containing the hydrotreatment reaction product and the catalyst in dispersed phase, before being sent to one or more distillation or flash units, is subjected to a high pressure separation pre-step in order to obtain a light fraction and a heavy fraction, the heavy fraction alone being sent to said distillation unit; and wherein the light fraction obtained by the high pressure separation pre-step is sent to a secondary hydrogenation post-treatment section, to produce a lighter fraction containing $C_1$-$C_4$ gas and $H_2S$ and a heavier fraction containing hydrotreated naphtha and gas oil.

2. The process according to claim 1, wherein the hydrogenation post-treatment reaction is effected at a pressure ranging from 7 to 14 MPa.

3. The process according to claim 1, wherein all the heavy feedstock is mixed with a suitable hydrogenation catalyst and sent to the hydrotreatment reactor, whereas at least 60% of the stream containing asphaltenes, which also contains catalyst in dispersed phase and is enriched with metals coming from the initial feedstock, is recycled to the hydrotreatment zone.

4. The process according to claim 3, wherein at least 80% of the stream containing asphaltenes is recycled to the hydrotreatment zone.

5. The process according to claim 1, wherein part of the heavy feedstock and at least most of the stream containing asphaltenes, which also contains catalyst in dispersed phase, are mixed with a suitable hydrogenation catalyst and sent to the hydrotreatment reactor, whereas the remaining part of the heavy feedstock is sent to the deasphalting zone.

6. The process according to claim 1, wherein at least most of the third stream containing asphaltenes, which essentially consists of said asphaltenes, is mixed with a suitable hydrogenation catalyst and sent to the hydrotreatment reactor, whereas all the heavy feedstock is fed to the deasphalting zone.

7. The process according to claim 1, wherein part of the distillation residue or liquid leaving the flash unit is recycled to the deasphalting zone and at least part of the remaining part of said distillation or flash residue is sent to the hydrotreatment reactor.

8. The process according to claim 7, wherein at least part of the distillation or flash residue is sent to the hydrotreatment reactor together with at least part of the stream containing asphaltenes coming from the deasphalting zone.

9. The process according to claim 1, wherein at least 80% by weight of the distillation residue is recycled to the deasphalting zone.

10. The process according to claim 9, wherein at least 95% by weight of the distillation residue is recycled to the deasphalting zone.

11. The process according to claim 1, wherein at least part of the remaining quantity of distillation residue, not recycled to the deasphalting zone is recycled to the hydrotreatment section.

12. The process according to claim 1, wherein the distillation unit is operated at a reduced pressure ranging from 0.0001 to 0.5 MPa.

13. The process according to claim 12, wherein the distillation unit is operated at a reduced pressure ranging from 0.001 to 0.3 MPa.

14. The process according to claim 1, wherein the hydrotreatment unit is operated at a temperature ranging from 370 to 480° C. and at a pressure ranging from 3 to 30 MPa.

15. The process according to claim 14, wherein the hydrotreatment unit is operated at a temperature ranging from 380 to 440° C. and at a pressure ranging from 10 to 20 MPa.

16. The process according to claim 1, wherein the deasphalting unit is operated at temperature ranging from 40 to 200° C. and at a pressure ranging from 0.1 to 7 MPa.

17. The process according to claim 1, wherein the deasphalting solvent is a light paraffin with from 3 to 7 carbon atoms.

18. The process according to claim 1, wherein the deasphalting unit is operated under subcritical or supercritical conditions with one or more steps.

19. The process according to claim 1, wherein the second stream comprising deasphalted oil is fractionated by means of conventional distillation.

20. The process according to claim 1, wherein the second stream comprising deasphalted oil is mixed with the products separated in the distillation step after being condensed.

21. The process according to claim 1, wherein the hydrogenation catalyst is a decomposable precursor or a preformed compound based on one or more transition metals.

22. The process according to claim 21, wherein the transition metal is molybdenum.

23. The process according to claim 1, wherein the concentration of the catalyst in the hydroconversion reactor, defined on the basis of the concentration of the metal or metals present, ranges from 300 to 20000 ppm.

24. The process according to claim 23, wherein the concentration of the catalyst in the hydroconversion reactor ranges from 1000 to 10000 ppm.

25. The process according to claim 1, wherein a fraction of the third stream containing asphaltenes, coming from the deasphalting zone, called flushing stream, is sent to a treatment section with a suitable solvent for the separation of the product into a solid fraction and a liquid fraction from which said solvent can be subsequently separated.

26. The process according to claim 25, wherein the flushing stream is in a quantity ranging from 0.5 to 10% by volume with respect to the feedstock.

27. The process according to claim 25, wherein at least part of the liquid fraction deriving from the treatment section of the flushing is sent as such or after being separated from the solvent and/or after the addition of a suitable fluxing liquid to the Fuel Oil fraction.

28. The process according to claim 27, wherein at least part of the liquid fraction deriving from the treatment section of the flushing is recycled to the hydrotreatment reactor.

29. The process according to claim 25, wherein the solvent used in the treatment section of the flushing is an aromatic solvent or a mixture of gas oils produced in the process itself or available in refineries.

30. The process according to claim 29, wherein the aromatic solvent is toluene and/or xylene blends.

31. The process according to claim 25, wherein the volumetric ratio solvent/flushing stream varies from 1 to 10.

32. The process according to claim 31, wherein the volumetric ratio solvent/flushing stream varies from 1 to 5.

33. The process according to claim 32, wherein the volumetric ratio solvent/flushing stream varies from 1.5 to 3.5.

34. The process according to claim 25, wherein the hydrogenation catalyst is a decomposable precursor or a preformed compound based on one or more transition metals and the solid fraction of the solid treated is sent to a further selective recovery treatment of the transition metal(s) contained in the hydrogenation catalyst.

35. The process according to claim 34, wherein the transition metal(s) recovered, is recycled to the hydrotreatment reactor.

36. The process according to claim 34, wherein the second stream consists of deasphaltated oil.

37. The process according to claim 1, wherein the first mixture is sent directly to the hydrotreatment reactor.

38. The process according to claim 1, wherein the high pressure separation pre-step forms only the lighter fraction and the heavier fraction, and the distillation forms only the distillation residue or liquid comprising the catalyst and one overhead fraction.

39. The process according to claim 1, wherein the high pressure separation pre-step forms only the lighter fraction and the heavier fraction, and the entire amount of the lighter fraction is hydrotreated in the secondary hydrogenation post-treatment section.

40. The process according to claim 1, wherein the high pressure separation pre-step is carried out at a pressure of from 3-14 MPa.

* * * * *

UNITED STATES PATENT AND TRADEMARK OFFICE

CERTIFICATE OF CORRECTION

PATENT NO. : 8,123,932 B2
APPLICATION NO. : 10/538886
DATED : February 28, 2012
INVENTOR(S) : Montanari et al.

It is certified that error appears in the above-identified patent and that said Letters Patent is hereby corrected as shown below:

On the title page, Item (73), the third Assignee's name is incorrect. Item (73) should read:

Item --(73) Assignees: Eni S.p.A., Rome (IT); Snamprogetti S.p.A., San Donato Milanese (IT); Enitecnologie S.p.A., San Donato Milanese (IT)--

Signed and Sealed this
Eighth Day of May, 2012

David J. Kappos

David J. Kappos
*Director of the United States Patent and Trademark Office*